US007077553B2

(12) United States Patent
Vanderschuit

(10) Patent No.: US 7,077,553 B2
(45) Date of Patent: Jul. 18, 2006

(54) LIGHTED BALLOONS

(76) Inventor: Carl R. Vanderschuit, 751 Turquoise St., San Diego, CA (US) 92109

( * ) Notice: Subject to any disclaimer, the term of this patent is extended or adjusted under 35 U.S.C. 154(b) by 72 days.

(21) Appl. No.: 10/797,251

(22) Filed: Mar. 10, 2004

(65) Prior Publication Data

US 2004/0233674 A1 Nov. 25, 2004

Related U.S. Application Data

(60) Provisional application No. 60/454,179, filed on Mar. 11, 2003.

(51) Int. Cl.
*A63J 17/00* (2006.01)

(52) U.S. Cl. ..... 362/565; 362/806; 362/253; 446/219; 446/220

(58) Field of Classification Search ..... 362/362, 362/806, 253, 565; 446/219, 220
See application file for complete search history.

(56) References Cited

U.S. PATENT DOCUMENTS

| | | | | |
|---|---|---|---|---|
| 2,383,390 | A | 8/1945 | Jacobs | |
| 2,619,303 | A | 11/1952 | Martin | |
| 2,758,803 | A | 8/1956 | Winzen | |
| 3,672,083 | A | 6/1972 | Moran | |
| 3,839,631 | A | 10/1974 | Goddard | |
| 4,048,565 | A | 9/1977 | Rice, Sr. | |
| 4,292,999 | A | 10/1981 | Szollmann | |
| 4,704,934 | A | 11/1987 | Nosrati | |
| 4,736,281 | A | 4/1988 | Neumeier | |
| 4,794,498 | A | 12/1988 | Neumeier | |
| 4,932,915 | A | 6/1990 | Boris et al. | |
| 5,117,344 | A | 5/1992 | Perez | |
| 5,119,281 | A * | 6/1992 | Akman | 362/253 |
| 5,143,439 | A | 9/1992 | Lewis et al. | |
| 5,499,941 | A | 3/1996 | Penjuke, Sr. | |
| 5,795,211 | A | 8/1998 | Carignan et al. | |
| 5,807,157 | A | 9/1998 | Penjuke | |
| 5,846,118 | A | 12/1998 | Wu | |
| 5,857,760 | A | 1/1999 | Pelton | |
| 5,879,219 | A | 3/1999 | Penjuke | |
| 5,931,412 | A | 8/1999 | Carloni | |
| 5,947,581 | A | 9/1999 | Schrimmer et al. | |
| 5,951,140 | A | 9/1999 | Feldman | |
| 6,072,280 | A | 6/2000 | Allen | |
| 6,106,135 | A | 8/2000 | Zingale et al. | |
| 6,142,415 | A | 11/2000 | Ambrico | |

(Continued)

FOREIGN PATENT DOCUMENTS

| | | | |
|---|---|---|---|
| CH | 662 931 | A | 11/1987 |

(Continued)

OTHER PUBLICATIONS

U.S. Appl. No. 10/341,239 entitled Mood-Enhancing Illumination Apparatus, Vanderschuit, Jan. 13, 2003.

(Continued)

*Primary Examiner*—Sandra O'Shea
*Assistant Examiner*—Meghan K. Dunwiddie
(74) *Attorney, Agent, or Firm*—Harness, Dickey & Pierce, P.L.C.

(57) ABSTRACT

A balloon apparatus includes a balloon having an inflation opening that can be closed for keeping the balloon inflated. The apparatus also includes a light source inside the balloon, wiring connecting a power source to the light source, and a tube through which the wiring extends. The tube may be entirely enclosed in the balloon. This balloon can be inexpensive to fabricate and can provide an attractive advertising medium.

46 Claims, 6 Drawing Sheets

U.S. PATENT DOCUMENTS

| | | | | |
|---|---|---|---|---|
| 6,146,001 | A | 11/2000 | Cwiakala | |
| 6,238,067 | B1 | 5/2001 | Hirsch | |
| 6,302,570 | B1 | 10/2001 | Petell et al. | |
| 6,371,638 | B1 * | 4/2002 | Zingale et al. | 362/565 |
| 6,416,198 | B1 | 7/2002 | Vanderschuit | |
| 6,523,778 | B1 * | 2/2003 | Key et al. | 244/31 |
| 6,933,707 | B1 | 8/2005 | Allen | |
| 2002/0145863 | A1 * | 10/2002 | Stultz | 362/96 |
| 2002/0149938 | A1 | 10/2002 | Allen | |
| 2003/0026088 | A1 | 2/2003 | Vanderschuit | |
| 2004/0046510 | A1 | 3/2004 | Allen | |
| 2004/0165384 | A1 | 8/2004 | Allen | |
| 2004/0201988 | A1 | 10/2004 | Allen | |
| 2006/0007679 | A1 | 1/2006 | Allen | |

FOREIGN PATENT DOCUMENTS

| | | | |
|---|---|---|---|
| DE | 299 18 185 | U | 1/2000 |
| EP | 0 231 471 | A | 8/1987 |
| GB | 2 392 973 | A | 3/2004 |
| WO | WO 93 18358 | A | 9/1993 |

OTHER PUBLICATIONS

U.S. Appl. No. 10/606,314 entitled Lighted Hat, Vanderschuit, Jun. 25, 2003.

U.S. Appl. No. 10/606,324 entitled Lighting Device, Vanderschuit, Jun. 25, 2003.

U.S. Appl. No. 10/606,325 entitled Lighted Hat, Vanderschuit, Jun. 25, 2003.

U.S. Appl. No. 10/786,995 entitled Therapeutic Devices and Methods for Applying Therapy, Vanderschuit, Feb. 25, 2004.

United Kingdom Combined Search and Examination Report dated Jan. 6, 2004; Application No. GB 0326549.3; 4 pages.

Supplementary European Search Report dated Mar. 1, 2004; App. No. EP 01 93 9305; 3 pages.

Light Up Ballon Stick, http://www.lightupballonstick.com/lubs/index.html, 2 pages.

* cited by examiner

LIGHTED BALLOONS

CROSS-REFERENCE TO RELATED APPLICATIONS

This application claims the benefit of U.S. Provisional Application No. 60/454,179, filed on Mar. 11, 2003. The disclosure of the above application is incorporated herein by reference.

BACKGROUND OF THE INVENTION

Balloons are beloved, as toys and as festive decoration, by both children and adults. Particularly popular are helium-filled balloons, which can almost seem to be alive when allowed to float freely through space. In recent years, Mylar® balloons, with their shiny, eye-catching surfaces, have become commonplace. Latex-based balloons are still popular and tend to be less expensive than Mylar® balloons, but are generally less "showy" than Mylar® balloons.

It is always desirable to make balloons more fun and interesting for children and adults. The inventor has observed that, since a balloon generally is an inexpensive but short-lived item, it also could be desirable to provide illumination and illuminated features for a balloon at a cost commensurate with the cost of the balloon.

SUMMARY OF THE INVENTION

The present invention, in one embodiment, is directed to a balloon apparatus that includes a balloon having an inflation opening that can be closed for keeping the balloon inflated. The apparatus also includes a light source inside the balloon, wiring connecting a power source to the light source, and a tube through which the wiring extends. The tube is entirely enclosed in the balloon.

In another embodiment, a balloon apparatus includes a balloon having an inflation opening that can be closed for keeping the balloon inflated. The apparatus also includes a light source inside the balloon wiring connecting a power source to the light source, a tube through which the wiring extends, and at least one member configured for display within the balloon. The tube supports at least one of the at least one member.

In another embodiment, a balloon apparatus includes a balloon having an inflation neck, a closure member configured to close the neck to keep the balloon inflated, a light source inside the balloon, wiring connecting a power source outside the balloon to the light source, and a device extending through the closed neck and supporting at least a portion of the wiring, the device being moveable by a user to thereby move the light source in the balloon.

In yet another embodiment, a kit for making a balloon apparatus includes a light source inserted or insertable within a balloon having an opening through which the balloon is inflatable. The kit also includes a power source connected or connectable to the light source via conductive wiring, and a tube through which the wiring is extended or extendable. The tube is configured to fit inside the balloon and support the light source when the balloon is inflated and the opening is sealed.

Another embodiment of a kit for making a balloon apparatus includes a light source inserted or insertable into a balloon, the balloon having a neck through which the balloon is inflatable, the neck being sealable to keep the balloon inflated. The kit also includes a gas-tight tube through which the wiring extends or is extendable. The tube has one end inserted or insertable into the balloon and configured to support the light source. The tube is further configured to extend outside the balloon when the balloon is inflated and the neck is sealed. Also included in the kit are a clip for sealing the neck, and a sleeve that fits over the tube and is configured to support the clip to prevent deflation of the balloon when the clip is applied to the neck. The sleeve is further configured to permit movement of the tube by a user to move the light source within the inflated balloon.

In another embodiment, a method of constructing a balloon apparatus includes extending wiring through a tube, electrically connecting the wiring between a light source and a power source, and inserting the light source and at least one end of the tube into a balloon through a neck through which the balloon is inflatable.

In yet another embodiment, a balloon apparatus includes a balloon having an inflation opening and an electroluminescent light source applied to an outside portion of the balloon.

BRIEF DESCRIPTION OF THE DRAWINGS

The present invention will become more fully understood from the detailed description and the accompanying drawings, wherein.

DETAILED DESCRIPTION OF EMBODIMENTS OF THE INVENTION

The following description of various embodiment(s) is merely exemplary in nature and is in no way intended to limit the invention, its application, or uses. Although embodiments of the present invention are described in connection with transparent, latex-based balloons, the invention is not so limited. Embodiments are contemplated in which many balloon types, shapes, sizes, colors, and degrees of transparency can be suitable. Such balloons include but are not limited to translucent, partly opaque balloons, and balloons of Mylar® and other materials.

Figure 1:
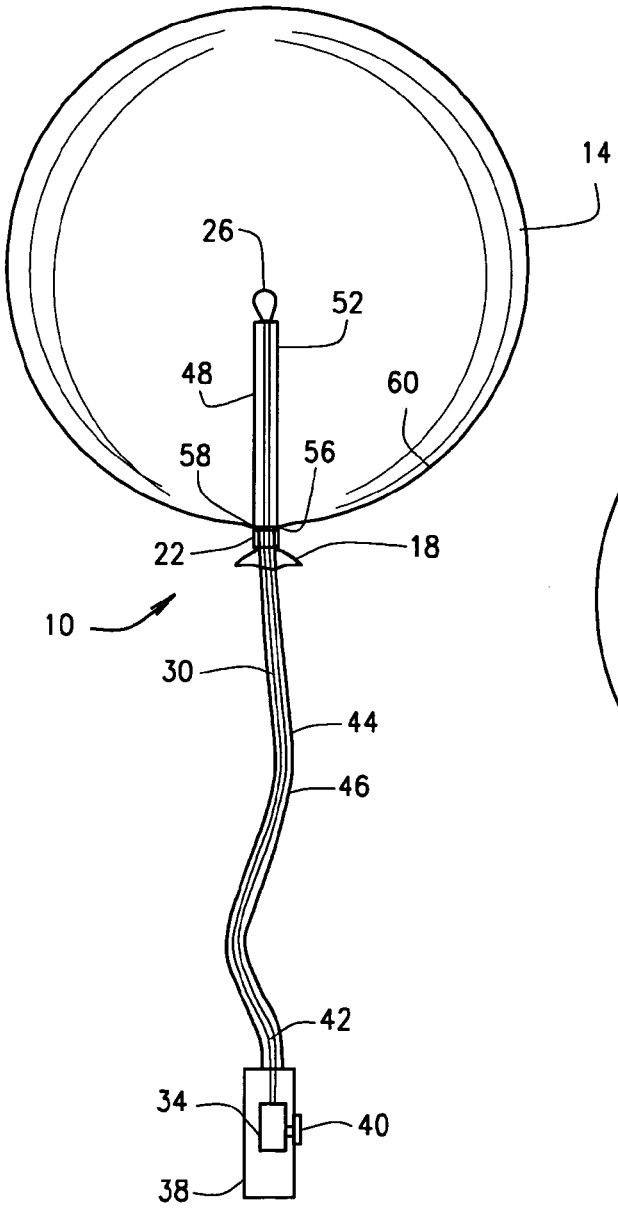
FIG. 1 is a perspective view of an embodiment of a balloon apparatus.

A balloon apparatus according to one embodiment of the present invention is indicated generally in FIG. 1 by reference number 10. The apparatus 10 includes an inflated balloon 14 having an inflation opening 18 that is closed for keeping the balloon 14 inflated. As shown in FIG. 1, the balloon 14 is a latex-based balloon, and the inflation opening 18 is a neck that is closed, for example, using a plastic clip 22. In other embodiments, the balloon may be fabricated of Mylar® or other material, and may have, for example, a translucent or transparent panel or window through which illumination may be visible. Whereas other balloons may have an inflation opening different from the opening 18, other closing devices may be used instead of the clip 22. The clip 22 (or other suitable closing device) is configured to seal the balloon 14 sufficiently to keep the balloon inflated, for example, for as long as one or two days while accommodating electrical wiring extending through the opening 18 as further described below. The clip 22 may be one of several clips commonly available for sealing balloons.

A light source 26 inside the balloon 14 is electrically connected via wiring 30 to a power source 34, for example, a battery enclosed in a casing 38 and operable via an off/on switch 40. The wiring 30 includes a pair of insulated wires 42 encased together in a coating 44 to form a single strand 46. The wiring 30 extends from the light source 26 through the closed neck 18 to the power source 34.

The wiring 30 extends through a hollow tube 48 that is enclosed in the balloon 14. The tube 48 is made, for example, of a lightweight plastic tubing the same as or comparable to that used in fabricating soda straws, although other suitable types of tubing could be used. An end 52 of the tube supports the light source 26, which, in the present embodiment, is fixedly mounted in the end 52. In the present embodiment, the light source 26 is a light-emitting diode (LED), although incandescent and other suitable light sources could be used. The LED 26 can be black-light emitting, and the balloon 14 may be black-light sensitive or include black-light sensitive portions. Generally, light sources described in connection with various embodiments of the present invention may include a black-light emitting light source, and balloons and/or other balloon apparatus components described in connection with various embodiments may be black-light sensitive at least in part.

An end 56 of the tube rests upon the inner surface 60 of the balloon near or over the closed inflation opening 18. It can be appreciated that the end 56 can be caused to locate on the inner surface 60 in a variety of ways, depending, for example, on a shape and/or diameter of the balloon 14, a length 58 of the wiring 30 between the end 56 and the inner surface 60, a degree of rigidity of the wiring 30, an angle of incline of the wiring 30 and/or the tube 48 from the opening 18, and/or a length of the tube 48. Thus it can be understood that the light source 26 can be oriented in a plurality of ways inside the balloon 14 while contact between the light source and the inner surface 60 is avoided.

Figure 2:
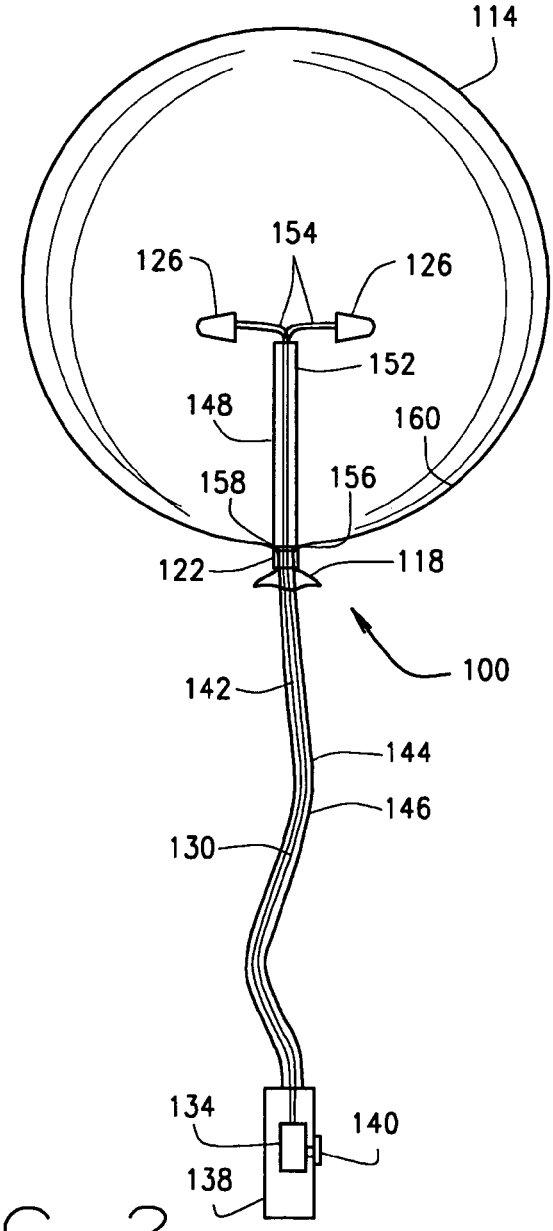
FIG. 2 is a perspective view of an embodiment of a balloon apparatus.

Another embodiment of a balloon apparatus is indicated generally in FIG. 2 by reference number 100. The apparatus 100 includes an inflated balloon 114 having an inflation opening 118 that is closed for keeping the balloon 114 inflated. As shown in FIG. 2, the balloon 114 is a transparent latex-based balloon, and the inflation opening 118 is a neck that is closed, for example, using a plastic clip 122. The balloon 114 may also be translucent. In other embodiments, the balloon may be fabricated of Mylar® or other material, and other closing devices may be used instead of the clip 122. The clip 122 (or other suitable closing device) is configured to seal the balloon 114 sufficiently to keep the balloon inflated, for example, for as long as one or two days while accommodating electrical wiring extending through the opening 118 as further described below.

A plurality of light sources 126, for example, two light sources 126, inside the balloon 114 are electrically connected via wiring 130 to a power source 134, for example, a battery enclosed in a casing 138 and operable via an off/on switch 140. In the present embodiment, the light sources 126 are light-emitting diodes (LEDs), although other suitable light sources could be used. The wiring 130 includes a plurality of pairs of insulated wires 142, each pair electrically connecting a corresponding light source 126 with the power source 134. In the embodiment shown in FIG. 2, the pairs of wires 142 are encased together in a coating 144 to form a single strand 146. In other embodiments, the insulated wires 142 may be coated, individually or together, so as to form a plurality of strands. The wiring 130 extends from the light sources 126 through the closed neck 118 to the power source 134.

The wiring 130 extends through a hollow tube 148 that is enclosed in the balloon 114. The tube 148 is made, for example, of a lightweight plastic tubing the same as or comparable to that used in fabricating soda straws, although other suitable types of tubing could be used. The wiring extends through an end 152 of the tube 148, from which the wiring is separated into its component pairs of wires 142. Each light source 126 thus is separated from the tube end 152 by a length 154 of its associated pair of wires 142. In the embodiment shown in FIG. 2, the light sources 126 are radially arranged relative to the tube end 152. The lengths 154 need not be equal, nor are they required to be straight. It can be appreciated that a variety of visual effects can be achieved by making the lengths 154 unequal and/or bending the lengths 154, particularly where more than two light sources 126 are provided. Embodiments also are contemplated wherein a single light source 126 is provided.

An end 156 of the tube rests upon the inner surface 160 of the balloon near or over the closed inflation opening 118. It can be appreciated that the end 156 can be caused to locate on the inner surface 160 in a variety of ways, depending, for example, on a shape and/or diameter of the balloon 114, a length 158 of the wiring 130 between the end 156 and the inner surface 160, a degree of rigidity of the wiring 130, an angle of incline of the wiring 130 and/or the tube 148 from the opening 118, and/or a length of the tube 148. Thus it can be understood that the light sources 126 can be oriented in a plurality of ways inside the balloon 114 while contact between the light source and the inner surface 160 can be avoided.

Figure 3:
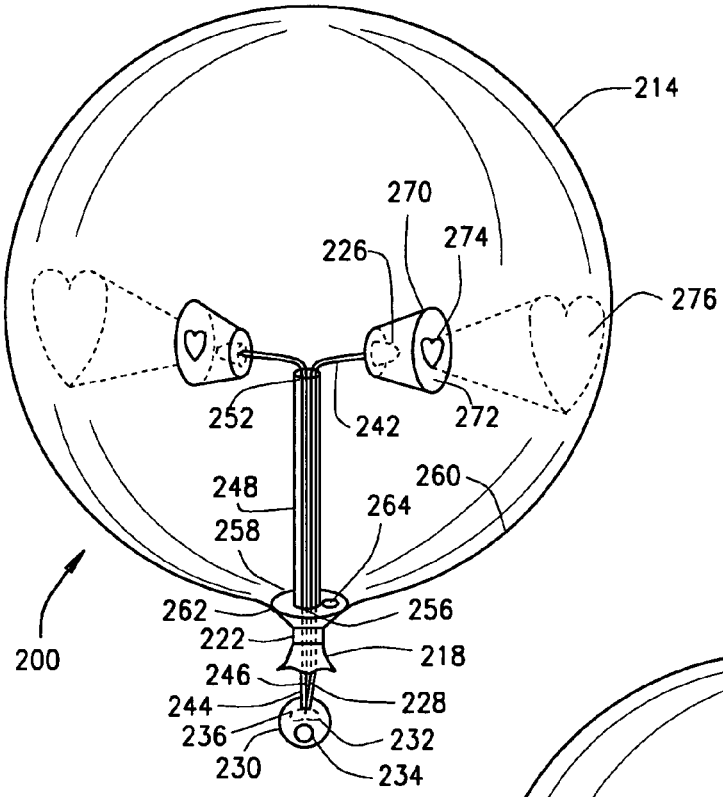
FIG. 3 is a perspective view of an embodiment of a balloon apparatus.

Another embodiment of a balloon apparatus is indicated generally in FIG. 3 by reference number 200. The apparatus 200 includes an inflated balloon 214 having an inflation opening 218 that is closed for keeping the balloon 214 inflated. As shown in FIG. 3, the balloon 214 is a latex-based balloon, and the inflation opening 218 is a neck that is closed, for example, using a plastic clip 222. In other embodiments, the balloon may be fabricated of Mylar® or other material, and other closing devices may be used instead of the clip 222. The clip 222 (or other suitable closing device) is configured to seal the balloon 214 sufficiently to keep the balloon inflated, for example, for as long as one or two days while accommodating electrical wiring extending through the opening 218 as further described below.

A plurality of light sources 226, for example, two light sources 226, inside the balloon 214 are electrically connected via wiring 228 to a power source, for example, a widely available control chip 230 having a battery 232 operable via a switch 234. The control chip 230 also includes a control circuit 236 for controlling the light sources 226 to provide such features as blinking, strobing and/or color changes. In the present embodiment, the light sources 226 are light-emitting diodes (LEDs), although other suitable light sources could be used. The wiring 228 includes a plurality of pairs of insulated wires 242, each pair electrically connecting a corresponding light source 226 with the power source 230. In the embodiment shown in FIG. 3, the pairs of wires 242 are encased together in a coating 244 to form a single strand 246. In other embodiments, the insulated wires 242 may be coated, individually or together, or selectively left uncoated, so as to form a plurality of strands. The wiring 228 extends from the light sources 226 through the closed neck 218 to the power source 230.

In the present embodiment, the power source 230 is attached close to, e.g., up to about one inch away from, the neck 218 of the balloon. The wiring 228 extends through a hollow tube 248 that is enclosed in the balloon 214. The tube 248 is made, for example, of a lightweight plastic tubing the same as or comparable to that used in fabricating soda straws, although other suitable types of tubing could be used. The wiring extends through an end 252 of the tube 248, from which the wiring is separated into its component pairs of wires 242.

An end 256 of the tube is inserted through an optional stabilizing collar 258 that rests upon the inner surface 260 and/or fits into a recess 262 formed by the closed neck 218 of the balloon 214. The collar 258 has a hole 264 through which the balloon 214 can be inflated. The collar 258 is made, for example, of plastic or other lightweight material sufficiently stiff to provide stabilization for the tube 248.

In the embodiment shown in FIG. 3, the light sources 226 are mounted in projection members 270. The projection members 270 are configured to project light from the light sources 226 onto the balloon inner surface 260. For example, as shown in FIG. 3, a projection surface 272 of each projection member 270 has a shape 274 through which light is projected. The shape 274 may be an aperture in the surface 272, or a writing or shape having a color and/or light transmissibility different from that of the surface 272. Thus the shape 274 is projected by the light source 226 onto and through the balloon 214 as a projection 276. Projection members 270 may be made, for example, of lightweight plastic or other suitable material sufficiently flexible to be inserted through the inflation opening 218 of the balloon. The projection surface 272 may be flat and/or curved. The surface 272 may be opaque, transparent, translucent or a combination thereof.

When the balloon apparatus 200 is in use, a user grasps the control chip 230 and switches the switch 234 to provide power to the light sources 226. The user may also twist the control chip 230 and wiring 228 to cause the light sources 226 to turn within the balloon.

Figure 4A:
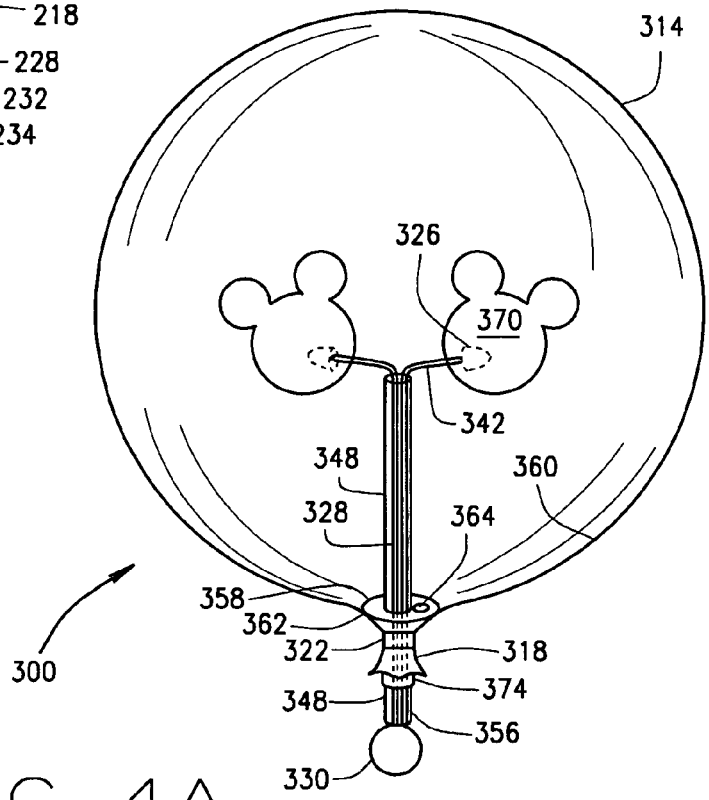
FIG. 4A is a perspective view of an embodiment of a balloon apparatus.
Figure 4B:
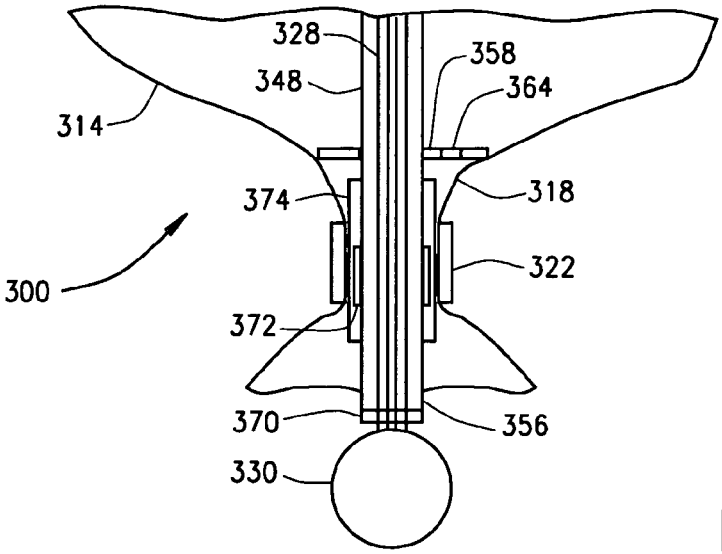
FIG. 4B is a cross-sectional partial view of the balloon apparatus shown in FIG. 4A.

Another embodiment of a balloon apparatus is indicated generally in FIGS. 4A and 4B by reference number 300. The apparatus 300 includes an inflated balloon 314 having an inflation opening 318 that is closed for keeping the balloon 314 inflated. As shown in FIG. 4A, the balloon 314 is a latex-based balloon, and the inflation opening 318 is a neck that is closed, for example, using a clip 322. The clip 322 in one embodiment is made of metal or plastic and completely encircles the opening 318, in the manner of a "slap" bracelet, with a spring tension sufficient to prevent deflation of the balloon. The clip 322 may include grooves into which an end of the clip is pushed to lock the clip. In other embodiments, the balloon may be fabricated of Mylar® or other material, and other closing devices may be used instead of the clip 322. The clip 322 (or other suitable closing device) is configured to seal the balloon 314 sufficiently to keep the balloon inflated, for example, for as long as one or two days while accommodating a tube and sleeve extending through the opening 318 as further described below.

A plurality of light sources 326, for example, two light sources 326, inside the balloon 314 are electrically connected via wiring 328 to a power source, for example, a control chip 330 the same as or similar to the chip 230 (shown in FIG. 3). In the present embodiment, the light sources 326 are light-emitting diodes (LEDs), although other suitable light sources could be used. The wiring 328 includes a plurality of pairs of insulated wires 342, each pair electrically connecting a corresponding light source 326 with the power source 330. The wiring 328 extends from the light sources 326 through the closed neck 318 to the power source 330.

In the present embodiment, the wiring 328 extends through a hollow tube 348 extending through the balloon neck 318. The tube 348 is made, for example, of a lightweight plastic tubing the same as or comparable to that used in fabricating soda straws, although other suitable types of tubing could be used.

An end 356 of the tube 348 is inserted through a stabilizing collar 358 that rests upon the inner surface 360 and/or fits into a recess 362 formed by the closed neck 318 of the balloon 314. The collar 358 has a hole 364 through which the balloon 314 can be inflated. A sleeve 374 fits over the tube 348 and supports the clip 322, as further described below.

In the embodiment shown in FIG. 4A, the light sources 326 are mounted in diffusion members 370. The diffusion members 370 are configured to diffuse light from the light sources 326. Diffusion members 370 may include translucent balloons and/or other translucent material such as lightweight plastic. Diffusion members 370 may have various shapes and sizes, may include writing, designs and textures and can be particularly effective where the balloon 314 is transparent. Although each diffusion member 370 in the embodiment shown in FIG. 4A diffuses light of a single light source 326, it should be noted that more than one light source 326 could be mounted in a single diffusion member 370. Generally, it is contemplated in connection with the embodiments described herein that a plurality of light sources can be grouped together for projection, diffusion, and the like.

A more detailed partial cross-sectional view of the balloon apparatus 300 is shown in FIG. 4B. The tube end 356 is closed by a gas-tight plug or seal 370, for example, of glue or adhesive, through which the wiring 328 extends for connection with the power supply 330. The seal 370 alternatively may be at the other end of, or inside, the tube 348, to prevent the escape of gas from the inflated balloon through the tube 348. The wiring in one embodiment is embedded in the seal.

A gasket 372 of rubber or other suitable flexible material fits snugly around the tube 348. The sleeve 374 fits around the gasket 372 and tube 348. The clip 322 fits tightly enough around the neck 318 and sleeve 374, for example, in "slip bracelet"fashion as previously described, to prevent the escape of gas from the balloon. The gasket 372 fits tightly enough around the tube 348 to prevent the escape of gas from the balloon around the tube 348, but is also sufficiently flexible to allow the tube 348 to be moved by a user holding and turning the tube end 356. When the balloon apparatus 300 is in use, a user grasping the tube end 356 can twist, spin, push and/or pull the tube 348 to cause the light sources 326 to move in various ways.

Figure 5:
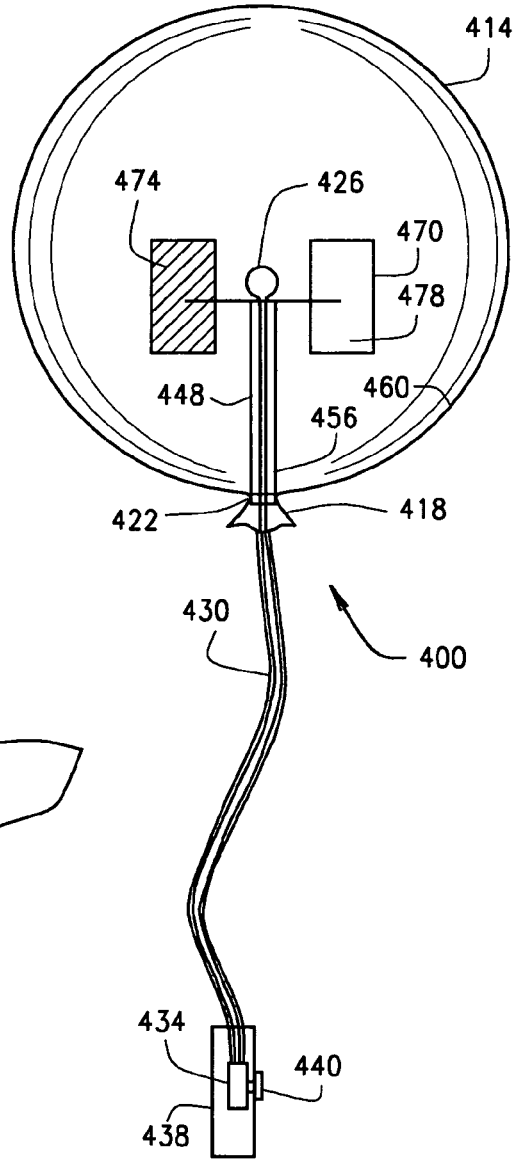
FIG. 5 is a perspective view of an embodiment of a balloon apparatus.

Another embodiment of a balloon apparatus is indicated generally in FIG. 5 by reference number 400. The apparatus 400 includes an inflated balloon 414 having an inflation opening 418 that is closed for keeping the balloon 414 inflated. As shown in FIG. 5, the balloon 414 is a latex-based balloon, and the inflation opening 418 is a neck that is closed, for example, using a plastic clip 422. In other embodiments, the balloon may be fabricated of Mylar® or other material, and other closing devices may be used instead of the clip 422.

A light source 426 inside the balloon 414 is electrically connected via wiring 430 to a power source 434, for example, a battery enclosed in a casing 438 and operable via an off/on switch 440. In the present embodiment, the light source 426 includes one or more light-emitting diodes (LEDs), although other suitable light sources could be used. The wiring 430 extends from the light source 426 through the closed neck 418 to the power source 434.

The wiring 430 extends through a hollow tube 448 that is enclosed in the balloon 414. The tube 448 is made, for example, of a lightweight plastic tubing the same as or comparable to that used in fabricating soda straws, although other suitable types of tubing could be used. An end 456 of the tube 448 rests upon the inner surface 460 of the balloon near or over the closed inflation opening 418. In another embodiment, a collar the same as or similar to the collar 258 (shown in FIG. 3) may be used to stabilize the tube 448.

A pair of spaced-apart flags 470 are configured to rotate freely about the light source 426. Each flag 470 includes, for example, a black side 474 and a silver side 478. The flags thus are configured to rotate, and thus to perform in the manner of a radiometer as known in the art, under radiant power, for example, from the power source 426, from the sun on a bright day, and/or from an indoor lamp. Although black and silver coloring is preferred, the flags 470 may have various colors and shapes.

Figure 6:
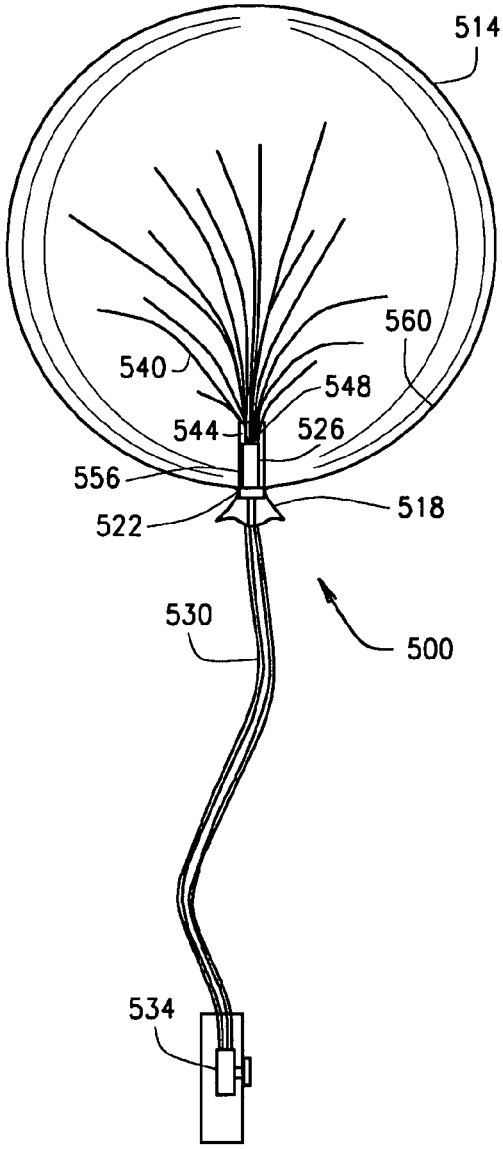
FIG. 6 is a perspective view of an embodiment of a balloon apparatus.

Another embodiment of a balloon apparatus is indicated generally in FIG. 6 by reference number 500. The apparatus 500 includes an inflated balloon 514 having an inflation opening 518 that is closed for keeping the balloon 514 inflated. As shown in FIG. 6, the balloon 514 is a latex-based balloon, and the inflation opening 518 is a neck that is closed, for example, using a plastic clip 522. In other embodiments, the balloon may be fabricated of Mylar® or other material, and other closing devices may be used instead of the clip 522.

A light source 526 inside the balloon 514 is electrically connected via wiring 530 to a power source 534. In the present embodiment, the light source 526 includes one or more light-emitting diodes (LEDs), although other suitable light sources could be used. The wiring 530 extends from the light source 526 through the closed neck 518 to the power source 534.

A plurality of optical fibers 540 have ends 544 that are gathered and aligned so as to fit closely together directly over the light source 526, and such that a focal point of the light source 526 matches the fiber ends 544. The optical fibers 540 and light source 526 have a diameter, for example, of about five millimeters. The fiber ends 544 are affixed over the light source 526 by a tube 548. The fibers 540 are permitted to fan out freely above the tube 548 and can have various lengths, depending on a desired display.

An end 556 of the tube 548 rests upon the inner surface 560 of the balloon near or over the closed inflation opening 518. The tube 548 is fabricated, for example, of heat shrink material applied around the wiring 530, blight source 526, and fiber ends 544 and blow-dried to shrink the material. Other suitable types of tubing could be used in place of or in addition to heat shrink material. The tube 548 can be of various lengths, depending on, for example, a height at which the optical fibers are desired to fan out above the tube 548. When the tube 548 is fabricated of heat shrink material, about a one-half-inch length of the tube 548 serves to hold the fiber ends 544 in place above the light source 526. The tube 548 could also be fabricated, for example, of clear plastic and could have a length of up to about two inches.

When the apparatus 500 is in use, the optical fibers 540 emit points of light that move with the fibers. Where the balloon 514 is transparent, the points of light are clearly visible. Where the balloon 514 is translucent, the light can appear as a soft glow.

Figure 7:
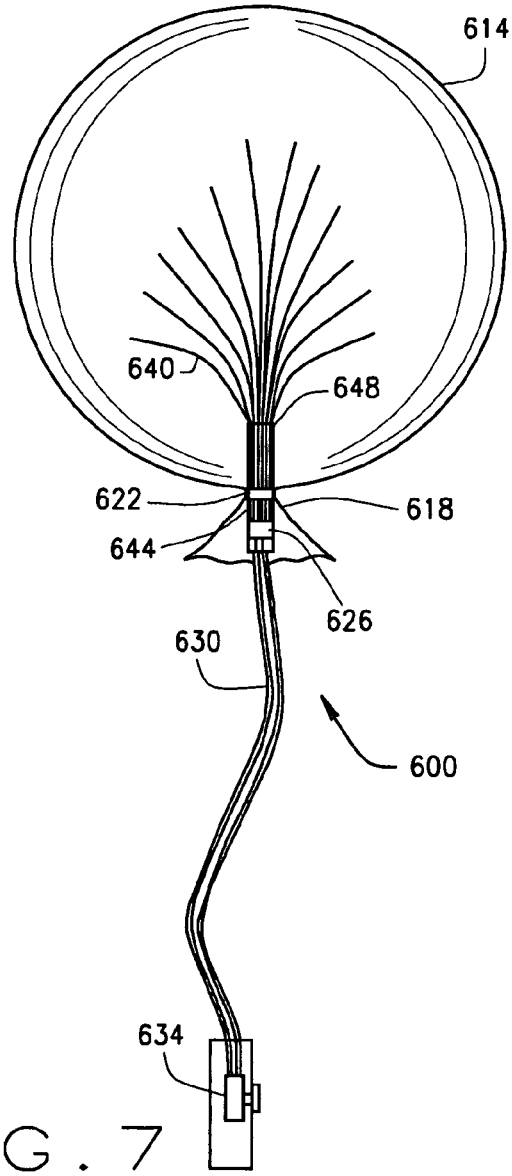
FIG. 7 is a perspective view of an embodiment of a balloon apparatus.

In another embodiment, and as shown in FIG. 7, a balloon apparatus 600 includes a balloon 614 having a neck 618 that is closed by a clip 622, preferably a "slip bracelet"-like, spring-tensioned clip having sufficient length to encircle and lock around the neck 618 and a tube extending through the neck 618 as further described below. A light source 626 outside the balloon 614 is connected via wiring 630 to a power source 634.

A plurality of optical fibers 640 have ends 644 that are gathered and aligned so as to fit closely together directly over the light source 626, and such that a focal point of the light source 626 matches the fiber ends 644. The fiber ends 644 are affixed over the light source 626 by a tube 648 extending over the light source 626 and into the balloon 614 through the neck 618. The fibers 640 are permitted to fan out freely above the tube 648 and can have various lengths, depending on a desired display.

The tube 648 is fabricated, for example, of heat shrink material applied around the wiring 630, light source 626, and fiber ends 644 and blow-dried to shrink the material. Other suitable types of tubing could be used in place of or in addition to heat shrink material, including but not limited to clear plastic tubing.

Figure 8:
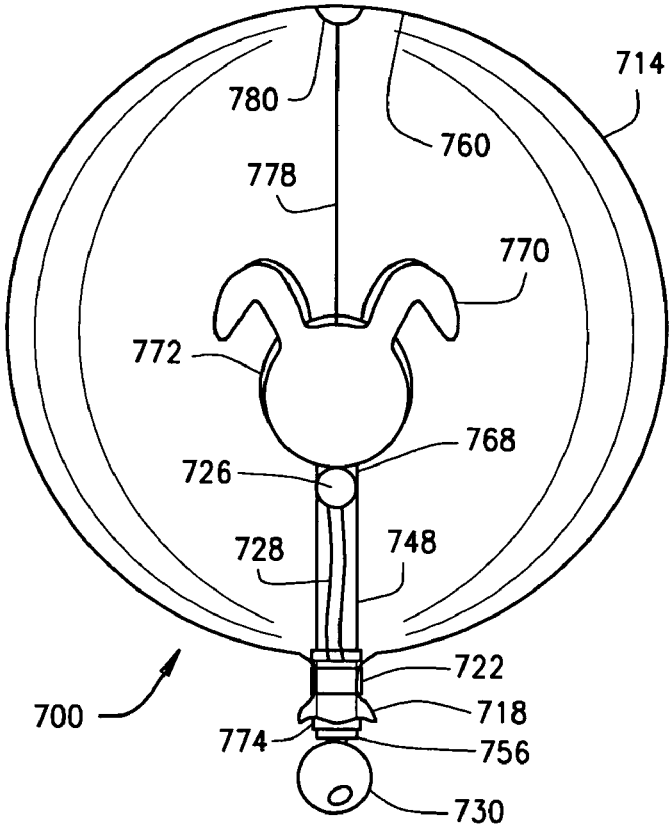
FIG. 8 is a perspective view of an embodiment of a balloon apparatus.

Another embodiment of a balloon apparatus is indicated generally in FIG. 8 by reference number 700. The apparatus 700 includes an inflated balloon 714 having an inflation opening 718 that is closed for keeping the balloon 714 inflated. As shown in FIG. 8, the balloon 714 is a latex-based balloon, and the inflation opening 718 is a neck that is closed, for example, using a clip 722. The clip 722 in one embodiment is made of plastic or metal and completely encircles the opening 718 in "slip bracelet"-like fashion, with a spring tension sufficient to prevent deflation of the balloon. In other embodiments, the balloon may be fabricated of Mylar® or other material, and other closing devices may be used instead of the clip 722. The clip 722 (or other suitable closing device) is configured to seal the balloon 714 sufficiently to keep the balloon inflated, for example, for as long as one or two days while accommodating a tube extending through the opening 718 as further described below.

A light source 726 inside the balloon 714 is electrically connected via wiring 728 to a power source, for example, a control chip 730 the same as or similar to the chip 230 (shown in FIG. 3). In the present embodiment, the light source 726 is a light-emitting diode (LED), although other suitable light sources could be used. The wiring 728 extends through a hollow tube 748. The tube 748 supports the light source and extends through the balloon neck 718. The tube 748 is made, for example, of a lightweight plastic tubing comparable to that used in fabricating soda straws. A sleeve 774 fits over the tube 748, as further described below.

An end 768 of the tube supports a display member 770 adjacent the light source 726. The display member 770 is fabricated, for example, of thin (e.g., one-eighth-inch), flexible soft vinyl or plastic and may be wholly or partially transparent, translucent and/or opaque. The display member 770 shown in FIG. 8 is substantially flat and transparent and has thin and/or etched edges 772. Light from the light source 726 is transmitted through the display member 770 and appears as a glowing border along the edges 772.

Depending, for example, on the weight and/or shape of a display member, it may be desirable to provide support for the display member relative to the balloon inner surface. Accordingly and for example, an optional thread 778 is affixed between the balloon inner surface 760 and the display member 770. The thread 778 may be elastic. Adhesive 780 may be used to affix the thread 778 to the balloon inner surface 760.

The display member 770 may have various shapes and sizes, may include printed designs, writing, textured, glowing and/or reflective areas, and can be particularly effective where the balloon 714 is transparent. A display member 770 presented in three dimensions, for example, a clear and/or reflective pyramid, disco ball, or other object, can transmit and/or reflect light from the light source 726 in many interesting ways and is attractive when viewed from any direction.

It is contemplated that each of a plurality of display members could be supported adjacent a corresponding light source. For example, a pair of display members 770 could be supported adjacent a pair of opposed light sources similar to the light sources 326 (shown in FIG. 4A). Such display members can be arranged so that light is transmitted and/or reflected from one to another display member, thereby increasing the play of light within and through the balloon.

The balloon apparatus 700 is sealed in the same or a similar manner as the balloon apparatus 300 (shown in FIGS. 4A and 4B). Thus the sleeve 774 fits around the tube 748, supports the clip 722, and also allows the tube 748 to be moved by a user holding and turning an end 756 of the tube 748. When the balloon apparatus 700 is in use, a user grasping the tube end 756 can twist, spin, push and/or pull the tube 748 to cause the light source 726 and the display member(s) to move in various ways.

Figure 9:
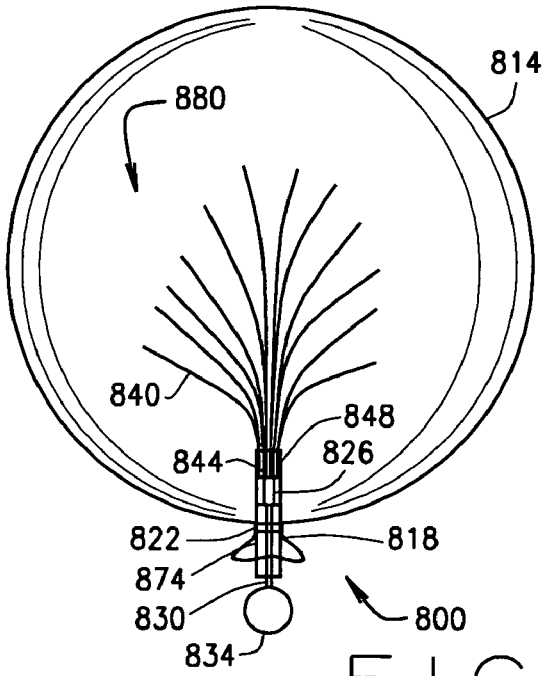
FIG. 9 is a perspective view of an embodiment of a balloon apparatus.

Another embodiment of a balloon apparatus is indicated generally in FIG. 9 by reference number 800. The apparatus 800 includes an inflated balloon 814 having an inflation opening 818 that is closed for keeping the balloon 814 inflated. As shown in FIG. 9, the balloon 814 is a latex-based balloon, and the inflation opening 818 is a neck that is closed, for example, using a plastic clip 822. In other embodiments, the balloon may be fabricated of Mylar® or other material, and other closing devices may be used instead of the clip 822.

A light source 826 inside the balloon 814 is electrically connected via wiring 830 to a power source 834. In the present embodiment, the light source 826 includes one or more light-emitting diodes (LEDs), although other suitable light sources could be used. The wiring 830 extends from the light source 826 through the closed neck 818 to the power source 834. The power source 834 may be a chip that provides various functions, e.g., strobing, blinking, causing different LEDs to emit different colors, and the like.

A plurality of optical fibers 840 have ends 844 that are gathered and aligned so as to fit closely together directly to form an optical fiber member 880 over the light source 826, and such that a focal point of the light source 826 matches the fiber ends 844. The optical fibers 840 and light source 826 have a diameter, for example, of about five millimeters. The fiber ends 844 are affixed over the light source 826 by a tube 848. The fibers 840 are permitted to fan out freely above the tube 848 and can have various lengths, depending on a desired display.

The tube 848 is fabricated, for example, of heat shrink material applied around the wiring 830, light source 826, and fiber ends 844 and blow-dried to shrink the material. Other suitable types of tubing could be used in place of or in addition to heat shrink material. The tube 848 can be of various lengths, depending on, for example, a height at which the optical fibers are desired to fan out above the tube 848. The tube 848 could also be fabricated, for example, of clear plastic.

The balloon apparatus 800 is sealed in the same or a similar manner as the balloon apparatus 300 (shown in FIGS. 4A and 4B). Thus a sleeve 874 fits around the tube 848 and supports the clip 822, and allows the tube 848 to be moved by a user holding and turning an end of the tube 848. When the balloon apparatus 800 is in use, a user grasping the tube end can twist, spin, push and/or pull the tube 848 to cause the light source 826 and the display member to move in various ways. The user can also use the control chip 834, for example, to turn the light source on and off and cause the light source to emit different colors, to strobe, and/or perform such functions as may be available via the chip 834. The optical fibers 840 emit points of light that move with the fibers. Where the balloon 814 is transparent, the points of light are clearly visible. Where the balloon 814 is translucent, the light can appear as a soft glow.

Figure 10:
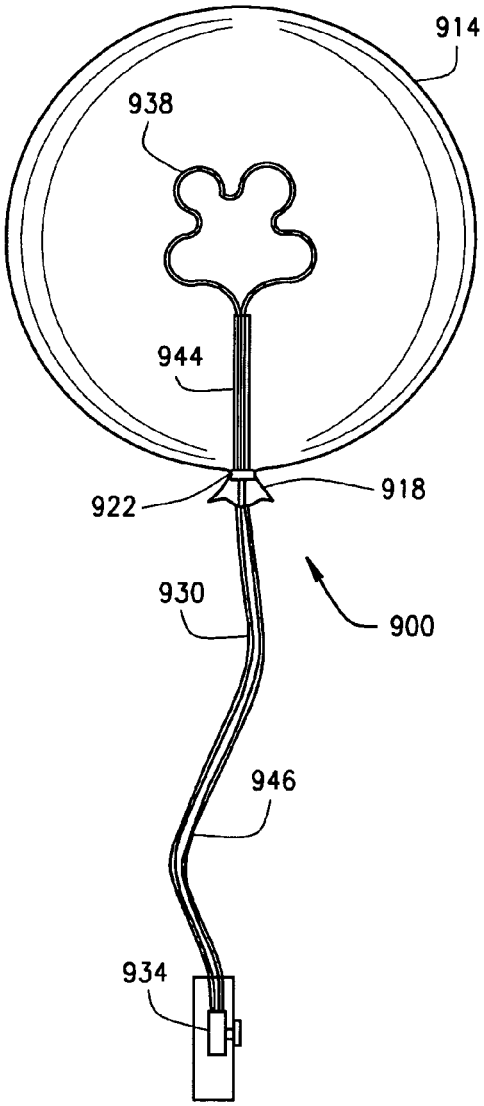
FIG. 10 is a perspective view of an embodiment of a balloon apparatus.

A balloon apparatus according to another embodiment of the present invention is indicated generally in FIG. 10 by reference number 900. The apparatus 900 includes an inflated balloon 914 having a neck 918 that is closed via a plastic clip 922. The clip 922 (or other suitable closing device) is configured to seal the balloon 914 sufficiently to keep the balloon inflated, for example, for as long as one or two days while accommodating electrical wiring extending through the opening 918 as further described below. The clip 922 may be one of several clips commonly available for sealing balloons.

Electroluminescent wire 930 connected to a power source 934 extends through the closed neck 918 into the balloon 914, wherein the wire 930 is shaped to form a display member 938. In the embodiment shown in FIG. 10, a clear coating or tubing 944 extends between the power source 934 and the display member 938. The tubing 944 surrounds and constrains the wire 930 to form a single strand 946. When the wire 930 receives power from the power source 934, the wire 930 and display member 938 become a light source that provides light inside and outside the balloon 914. The wire 930 may have a "memory" such that the wire is flexible yet can retain a shape into which it is formed. Accordingly, in other embodiments, the tubing 944 may be at least partially omitted where, for example, portions of the wire 930 are twisted together to form a single strand.

Figure 11:
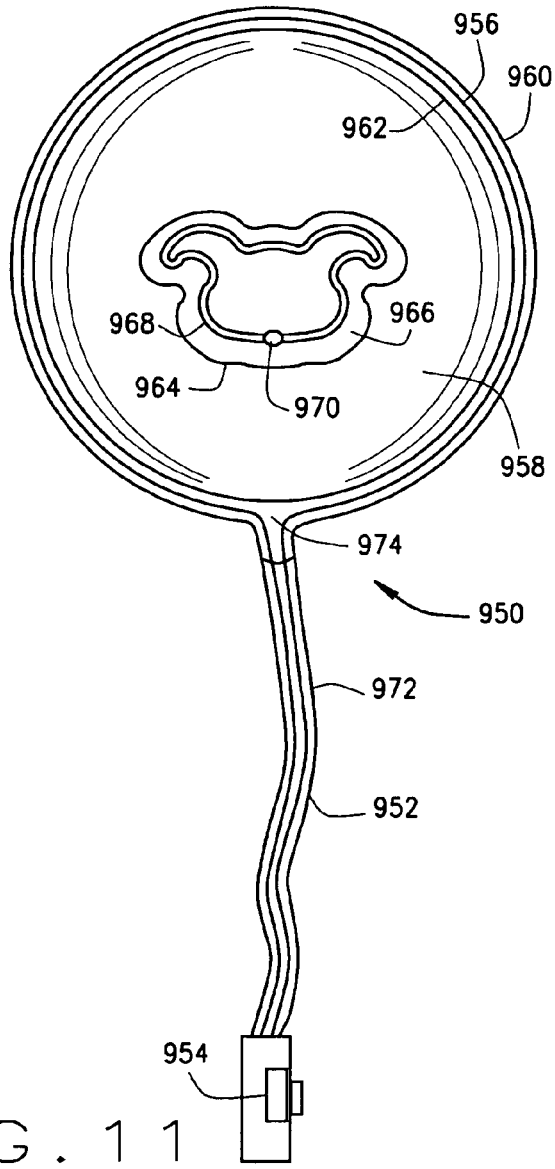
FIG. 11 is a perspective view of an embodiment of a balloon apparatus.

In yet another embodiment of a balloon apparatus indicated generally in FIG. 11 by reference number 950, electroluminescent wire or material 952 extends from a power source 954 to form a display member 956 around a Mylar® balloon 958. The display member 956 is enclosed, for example, in a clear casing 960 formed by turning over and sealing a seam 962 at which halves of the balloon 958 are joined together. When the power source 954 is activated, the wire 952 and display member 956 both provide light. The balloon 958 also includes a display member 964. The display member 964 includes a sticker 966 that is clear and/or translucent at least in part, such that electroluminescent wire 968 beneath the sticker 966 can be visible. The sticker 966 is applied over the wire 968 and onto the balloon 958. In another embodiment, the wire 968 includes a sticky backing whereby the wire 968 can be applied directly onto the balloon. The wire 968 is connected to a power supply 970, which may be a button battery. The wire 968 alternatively could be connected to the power supply 954. In the embodiment shown in FIG. 11, clear tubing 972 constrains the wire 952 between the power source 954 and a closure member 974.

It can be understood that a person desiring to assemble a balloon apparatus in the manner described above would find a kit useful for making a balloon apparatus. Thus one embodiment of a kit for making a balloon apparatus includes a balloon having an opening through which the balloon is inflatable, the opening being sealable to keep the balloon inflated; a light source insertable within the balloon; a power source connectable to the light source via conductive wiring; and a tube through which the wiring is extendable, the tube configured to fit inside the balloon and support the light source when the balloon is inflated and the opening is sealed. Such a kit could also include one or more display member (s), diffusion member(s), projection member(s), and/or optical fiber member(s).

Another embodiment of a kit for making a balloon apparatus includes a balloon having a neck through which the balloon is inflatable, the neck being sealable to keep the balloon inflated; a light source insertable into the balloon; a power source connectable to the light source via wiring; a gas-tight tube through which the wiring extends, the tube having one end insertable into the balloon and configured to support the light source, the tube further configured to extend outside the balloon when the balloon is inflated and the neck is sealed; a clip for sealing the neck; and a sleeve that fits over the tube and is configured to support the clip to prevent deflation of the balloon when the clip is applied to the neck, the sleeve further configured to permit movement of the tube by a user to move the light source within the inflated balloon.

The foregoing embodiments exemplify only a few of the many combinations of features possible within the scope of the invention. Balloons illuminated according to the above described principles are attractive, inexpensive to fabricate, and offer a variety of opportunities for play and decoration. These balloons also can provide a medium for advertising that is fun, eye-catching and inexpensive.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A balloon apparatus comprising a balloon having an inflation opening that can be closed for keeping the balloon inflated, a light source inside the balloon, wiring connecting a power source to the light source, a tube through which the wiring extends, and one or more members configured for show within the balloon, wherein the tube supports at least one of the one or more members, wherein the one or more members configured for show comprise at least one of a projection member, a diffusion member, a flag, an optical fiber, and a display member.

2. The balloon apparatus of claim 1, wherein the wiring extends through the inflation opening.

3. The balloon apparatus of claim 1, wherein the tube comprises an end supporting the light source.

4. The balloon apparatus of claim 1, wherein the tube comprises an end that rests adjacent the closed inflation opening.

5. The balloon apparatus of claim 1, further comprising a plurality of light sources connected via the wiring to the power source.

6. The balloon apparatus of claim 5, wherein the wiring is configured to separate at least one of the light sources from an end of the tube.

7. The balloon apparatus of claim 6, wherein the light sources are radially arranged relative to the tube end.

8. The balloon apparatus of claim 1, wherein the tube is configured to support an optical fiber adjacent the light source.

9. The balloon apparatus of claim 1, wherein at least one of the light source and the wiring comprises electroluminescent wire.

10. The balloon apparatus of claim 1, wherein the light source comprises a black light source.

11. A kit for constructing the balloon apparatus of claim 1.

12. The balloon apparatus of claim 1, further comprising a closure member configured for positioning about and closing the inflation opening to keep the balloon inflated.

13. The balloon apparatus of claim 1, further comprising a clip for sealing the neck, and a sleeve that fits over the tube and is configured to support the clip to prevent deflation of the balloon when the clip is applied to the neck, the sleeve further configured to permit movement of the tube by a user to move the light source within the inflated balloon.

14. The balloon apparatus of claim 1, further comprising a gasket configured to be filled at least partially over the tube, a sleeve configured to be fitted at least partially over the gasket and positioned at least partially within the inflation opening, and a clip configured for positioning about and closing the inflation opening to keep the balloon inflated.

15. The balloon apparatus of claim 1, wherein the tube is entirely enclosed within the balloon.

16. The balloon apparatus of claim 1, further comprising a stabilizing collar positioned at least partially within the balloon, the collar having a hole through which the tube extends.

17. The balloon apparatus of claim 1, wherein the tube comprises a heat-shrinkable material.

18. A balloon apparatus comprising a balloon having an inflation opening that can be closed for keeping the balloon inflated, a light source inside the balloon, wiring connecting a power source to the light source, a tube through which the wiring extends, the tube substantially entirely enclosed in the balloon, and a projection member configured to direct light from the light source.

19. The balloon apparatus of claim 18, wherein the light source is mounted in the projection member.

20. The balloon apparatus of claim 18, wherein the projection member comprises a surface having a shape that is projected by the light source through the balloon.

21. The balloon apparatus of claim 20, wherein the shape is defined by at least one of an aperture and a color.

22. A balloon apparatus comprising a balloon having an inflation opening that can be closed for keeping the balloon inflated, a light source inside the balloon, wiring connecting a power source to the light source, a tube through which the wiring extends, the tube substantially entirely enclosed in the balloon, and a diffusion member configured to diffuse light from the light source.

23. A balloon apparatus comprising a balloon having an inflation opening that can be closed for keeping the balloon inflated, a light source inside the balloon, wiring connecting a power source to the light source, and a tube through which the wiring extends, the tube substantially entirely enclosed in the balloon, wherein the tube is configured to support a display member adjacent the light source.

24. The balloon apparatus of claim 23, wherein the display member comprises an edge through which light from the light source is transmitted.

25. A balloon apparatus comprising a balloon having an inflation opening that can be closed for keeping the balloon inflated, a light source inside the balloon, wiring connecting a power source to the light source, a tube through which the wiring extends, and one or more members configured for show within the balloon, wherein the tube supports at least one of the one or more members, wherein at least one of the light source, the wiring, and the one or more members configured for show comprise electroluminescent wire.

26. A kit for constructing the balloon apparatus of claim 25.

27. A balloon apparatus comprising a balloon having an inflation neck, a closure member configured to close the neck to keep the balloon inflated, a light source inside the balloon, wiring connecting a power source outside the balloon to the light source, and a device extending through the closed neck and supporting at least a portion of the wiring, the device being moveable by a user to thereby move the light source in the balloon, wherein the light source comprises at least one of a light-emitting diode, an optical fiber, and electroluminescent wire.

28. The balloon apparatus of claim 27 wherein the closure member comprises a clip.

29. The balloon apparatus of claim 27 wherein the device comprises a tube through which the wiring extends.

30. The balloon apparatus of claim 27 wherein the light source comprises a black light source.

31. The balloon apparatus of claim 27 further comprising electroluminescent wire comprised by at least one of the light source and the wiring.

32. A kit for constructing the balloon apparatus of claim 26.

33. A balloon apparatus comprising a balloon having an inflation neck, a closure member configured to close the neck to keep the balloon inflated, a light source inside the balloon, wiring connecting a power source outside the balloon to the light source, a device extending through the closed neck and supporting at least a portion of the wiring, the device being moveable by a user to thereby move the light source in the balloon, and configured for show inside the balloon, at least one of a projection member, a diffusion member, a flag, an optical fiber, and a display member.

34. A kit for making a balloon apparatus, the kit comprising a light source inserted or insertable within a balloon having an opening through which the balloon is inflatable, a power source connected or connectable to the light source via conductive wiring, a tube through which the wiring is extended or extendable, the tube configured to fit inside the balloon and support the light source when the balloon is inflated and the opening is sealed, and at least one of a projection member, a diffusion member, a flag, an optical fiber, and a display member inserted or insertable in the balloon.

35. A kit for making a balloon apparatus, the kit comprising:

a light source inserted or insertable into a balloon, the balloon having a neck through which the balloon is inflatable, the neck being sealable to keep the balloon inflated;

a gas-tight tube through which wiring extends or is extendable, the tube having one end inserted or insertable into the balloon and configured to support the light source, the tube further configured to extend outside the balloon when the balloon is inflated and the neck is sealed;

a clip for sealing the neck; and a sleeve that fits over the tube and is configured to support the clip to prevent deflation of the balloon when the clip is applied to the neck, the sleeve further configured to permit movement of the tube by a user to move the light source within the inflated balloon.

36. The kit of claim 35 further comprising a power source connected or connectable to the light source via wiring.

37. The kit of claim 35 further comprising at least one of a projection member, a diffusion member, a flag, an optical fiber, and a display member inserted or insertable in the balloon.

38. A method of constructing a balloon apparatus, the method comprising extending wiring through a tube, electrically connecting the wiring between a light source and a power source, inserting the light source and at least one end of the tube into a balloon through a neck through which the balloon is inflatable, inflating the balloon, and sealing the neck, wherein sealing the neck further comprises fitting a gasket over the tube, a sleeve over the gasket, the neck over the sleeve, and a clip over the neck.

39. A method of constructing a balloon apparatus, the method comprising extending wiring through a tube, electrically connecting the wiring between a light source and a power source, inserting the light source and at least one end of the tube into a balloon through a neck through which the balloon is inflatable, and configuring the tube to be held at one end and moved to move the light source within the inflated balloon.

40. A method of constructing a balloon apparatus, the method comprising extending wiring through a tube, electrically connecting the wiring between a light source and a cower source, inserting the light source and at least one end of the tube into a balloon through a neck through which the balloon is inflatable, and inserting into the balloon at least one of a diffusion member, a flag, an optical fiber, and a display member.

41. The method of claim 40 further comprising inflating the balloon and sealing the neck.

42. The method of claim 41 wherein sealing the neck comprises plugging the tube.

43. The method of claim 40 further comprising supporting the light source inside the balloon using the tube.

44. A method of constructing a balloon apparatus, the method comprising extending wiring through a tube, electrically connecting the wiring between a light source and a cower source, inserting the light source and at least one end of the tube into a balloon through a neck throuah which the balloon is inflatable, wherein inserting at least one end of the tube into a balloon comprises:

inserting the tube through a stabilizing collar; and inserting the collar through the neck.

45. A balloon apparatus comprising a balloon having an inflation opening, and an electroluminescent light source applied to an outside portion of the balloon, wherein the balloon comprises a seam and a casing formed at the seam, the light source comprising electroluminescent wire inside the casing.

46. The apparatus of claim 45 further comprising a display member applied to a surface of the balloon, the display member comprising the light source.

* * * * *

UNITED STATES PATENT AND TRADEMARK OFFICE

CERTIFICATE OF CORRECTION

PATENT NO. : 7,077,553 B2
APPLICATION NO. : 10/797251
DATED : July 18, 2006
INVENTOR(S) : Carl R. VanderSchuit It is certified that error appears in the above-identified patent and that said Letters Patent is hereby corrected as shown below:

Column 14, line 37: replace “cower” with --power--

Column 14, line 51: replace “cower” with --power--

Signed and Sealed this

Twenty-fourth Day of October, 2006

JON W. DUDAS
*Director of the United States Patent and Trademark Office*